US009512983B2

(12) United States Patent
Burmeister

(10) Patent No.: US 9,512,983 B2
(45) Date of Patent: Dec. 6, 2016

(54) LAMP

(75) Inventor: Jens Burmeister, Eberbach (DE)

(73) Assignee: Cooper Crouse-Hinds GmbH, Soest (DE)

( * ) Notice: Subject to any disclaimer, the term of this patent is extended or adjusted under 35 U.S.C. 154(b) by 0 days.

(21) Appl. No.: 13/813,722

(22) PCT Filed: Jun. 16, 2011

(86) PCT No.: PCT/EP2011/002981
§ 371 (c)(1),
(2), (4) Date: Apr. 8, 2013

(87) PCT Pub. No.: WO2012/016609
PCT Pub. Date: Feb. 9, 2012

(65) Prior Publication Data

US 2013/0215621 A1 Aug. 22, 2013

(30) Foreign Application Priority Data

Aug. 3, 2010 (DE) ..... 10 2010 033 141

(51) Int. Cl.

| | |
|---|---|
| ***F21V 13/02*** | (2006.01) |
| ***F21V 3/04*** | (2006.01) |
| ***F21V 9/00*** | (2015.01) |
| ***F21V 11/00*** | (2015.01) |
| *F21Y 103/00* | (2016.01) |

(52) U.S. Cl.
CPC ..... *F21V 13/02* (2013.01); *F21V 3/04* (2013.01); *F21V 9/00* (2013.01); *F21V 11/00* (2013.01); *F21Y 2103/00* (2013.01)

(58) Field of Classification Search
CPC ..... F21V 13/02; F21V 3/04
See application file for complete search history.

(56) References Cited

U.S. PATENT DOCUMENTS

| | | | | |
|---|---|---|---|---|
| 4,173,778 | A * | 11/1979 | Snavely et al. | 362/297 |
| 5,716,123 | A | 2/1998 | Lamming | |
| 7,093,956 | B2 | 8/2006 | Miller et al. | |
| 2005/0134182 | A1* | 6/2005 | Ishigami et al. | 313/638 |
| 2005/0140292 | A1* | 6/2005 | Tiesler-Wittig | 313/524 |
| 2006/0152155 | A1* | 7/2006 | Henninger et al. | 313/573 |

FOREIGN PATENT DOCUMENTS

| | | | |
|---|---|---|---|
| CN | 101045550 | A | 10/2007 |
| DE | 8102027 | U1 | 6/1981 |
| DE | 29806976 | U1 | 7/1998 |

(Continued)

OTHER PUBLICATIONS

Authorized officer Antoniu Arboreanu, International Search Report/ Written Opinion in PCT/EP2011/002981, mailed Aug. 9, 2011, 2 pages.

(Continued)

*Primary Examiner* — Elmito Breval
(74) *Attorney, Agent, or Firm* — Fish & Richardson P.C.

(57) ABSTRACT

A luminaire including a luminaire housing and a transparent or translucent cover. The illuminants and associated electric or electronic components can be arranged in the luminaire housing and the cover is detachably connected to the luminaire housing. A filter for spectrally filtering the light emitted by the illuminants is assigned to the cover. The spectral filtering is adapted to filter light in at least a certain spectral range, in which a certain animal is more sensitive than a human being.

10 Claims, 1 Drawing Sheet

(56) References Cited

FOREIGN PATENT DOCUMENTS

| | | | | |
|---|---|---|---|---|
| DE | 10011304 | A1 | | 9/2001 |
| DE | 20204352 | U1 | | 7/2002 |
| DE | 102004059786 | A1 | | 6/2006 |
| EP | 1258675 | A2 | | 11/2002 |
| JP | 2009230872 | A | | 10/2009 |
| KR | CN101045550 | | * | 3/2007 |
| WO | WO03085319 | A1 | | 10/2003 |

OTHER PUBLICATIONS

German Examination Report, dated Apr. 11, 2011, 4 pages.
First Search Report for Chinese Application No. 201180038103.1 mailed Oct. 18, 2013.
English translation of German Office Action in German Application No. 102010033141.4-54, issued Apr. 11, 2011.
Office Action for Russian Application No. 2013105494/12, mailed Aug. 22, 2014.
Translation of Office Action for Saudi Arabian Application No. 111320664, mailed Aug. 11, 2014.
"Ex-Lighting Solutions for Gorgon Plant Environment," Hazardous Area International, vol. 5, Issue 3, Aug. 19, 2011.
Horch, K.W., et al., Visual Spectral Sensitivity of Hatchling Loggerhead (Caretta caretta L.) and Leatherback (Dermochelys coriacea L.) Sea Turtles, as Determined by Single-Flash Electroretinopathy, Marine and Freshwater Behaviour and Physiology, vol. 41, No. 2, Jun. 2008 79-91.
Environmental Assessment Guidelines No. 5, Environmental Assessment Guideline for Protecting Marine Turtles from Light Impacts, Environmental Protection Authority, Nov. 2010, Western Australia, Australia.

* cited by examiner

LAMP

CROSS-REFERENCE TO RELATED APPLICATIONS

This application is a U.S. National Stage application under 35 U.S.C. §371 of International Application Number PCT/EP2011/002981, filed Jun. 16, 2011, which claims priority from German Application No. 10 2010 033 141.4, filed Aug. 3, 2010.

TECHNICAL FIELD

The disclosure relates to a luminaire including a luminaire housing and a transparent or translucent protective trough or protective cover. Illuminants and associated electric or electronic components are arranged in the luminaire housing. The protective trough or protective cover is detachably connected to the luminaire housing.

BACKGROUND

Luminaries may be ceiling lights, suspended lights, pendant lights, mast lights or emergency lights. Such an emergency light may be constructed like one of the beforementioned lights. Such an emergency light may also be an explosion-proof light.

The protective trough or protective cover of such a luminaire may be made of different transparent or translucent materials such as glass, polycarbonate or also of other materials. Moreover, the "protective trough" or "protective cover" may also be constructed like a glass bulb or the like.

Depending on the used illuminant, the associated electric or electronic components are, for instance, a ballast, a starter, a temperature- or also a pressure-measuring device, a fuse or the like.

The corresponding protective trough may be detachably connected to the luminaire housing by a number of screws or the like. Also, it is possible that the protective trough is pivotably mounted on the luminaire housing, for instance by a hinged connection, and can be locked in a corresponding locked position.

In such a prior luminaire the illuminant has a corresponding spectral range for the emitted light. Also, as a rule, no other restrictions with respect to the emission of light are arranged in the protective trough, wherein the emission of light is determined, as a rule, by one or more reflectors arranged inside the luminaire housing, at least with respect to the intensity distribution.

However, light has an influence on the environment, which shows, for instance, in an influence of the natural activities of animals. The reason for this may be that certain animals are more sensitive in certain spectral ranges of the light and may therefore be negatively or also positively influenced by light emitted in this spectral range. This may be the case, for instance, in connection with street lighting, the illumination of pavements or also the illumination of parks or the like.

Furthermore, it can often be noticed in connection with luminaries that they emit light at a relatively large aperture angle. However, in order to illuminate a road, objects etc. only a smaller aperture angle range for such a light is required. The aperture angle exceeding this required aperture angle range is substantially unused and results in a light contamination of the environment, that is, light is emitted to regions in which it is not used or not required.

This also applies to other usages of light, for instance, in rooms in which certain spectral ranges of the emitted light could cause reactions or the like, see for instance biological, chemical or also physical applications.

SUMMARY

Therefore, an object of the present disclosure is to allow in an easy constructive and variable manner for limitation of the emitted light both in spectral respects and spatial respects.

This object is achieved by the features of claim 1.

A spectral limitation of the emitted light is accomplished with a filtering element, such as a filter, assigned to the protective trough. This filtering element blocks out a certain spectral range, or also several certain spectral ranges from the light emitted by the illuminant.

A spatial limitation of the light can additionally or also alternatively be obtained by a glare-limiting element, such as a glare-limiter, assigned to the protective trough, which ensures that the luminaire emits the light only to one or to more specific areas.

In order to be able to correspondingly fix the filtering element and the glare-limiting element in the luminaire in an easy manner they may be assigned to a trough inner side of the protective trough. This means that light emitted by the illuminant towards the protective trough is limited correspondingly spectrally or also geometrically in the area of the trough inner side. In the simplest case, the filtering element and/or the glare-limiting element are arranged on the trough inner side. Thus, there is no need for the arrangement of separate auxiliary holding elements or mounting elements for the filtering element and/or the glare-limiting element.

With respect to the filtering element it is conceivable that this filtering element is a filtering film or filtering coating arranged on or applied to the trough inner side.

In order to obtain a corresponding spectral filtering in the area of the protective trough as a whole, the filtering element may be applied or arranged in a surface-covering fashion to/on corresponding transparent or translucent areas of the protective trough on the through inner side. If the protective trough as a whole is transparent or translucent, the complete trough inner side may be provided with such a filtering element correspondingly.

Analogously, also the glare-limiting element may be arranged on the trough inner side, so that in this case, too, no separate auxiliary mounter or holder is necessary.

With respect to the glare-limiting element it may, moreover, be an advantage if it is inserted into or glued to the protective trough.

In this connection it will be appreciated that the glare-limiting element is not arranged on the trough inner side to cover the complete surface, as no light would emerge from the luminaire otherwise. Instead, the glare-limiting element spares specific selected areas of the protective trough so that the light can emerge through these areas.

In one embodiment the glare-limiting element may be an opaque film. An opaque coating on the corresponding areas of the trough inner side is conceivable as well.

For the filtering element a coated plastic film may be used, wherein the coating is selected corresponding to the spectral filtering.

If both the filtering element and the glare-limiting element are used, they may be arranged in different areas of the protective trough. Also, it is possible that the filtering element and the glare-limiting element are formed to be complementary relative to the protective trough. This means that the corresponding filtering element may be arranged in areas of the protective trough that are spared by the glare-limiting element for light to emerge there through.

In this connection, the filtering element may be arranged or applied in the above-described manner at least in/to an area of the protective trough that is not covered by the glare-limiting element.

In order to make use of the glare-limiting element for mounting the filter, where applicable, the glare-limiting element may be arranged between the trough inner side of the protective trough and the filter. This applies only to those areas, however, in which both the glare-limiting element and the filtering element are arranged. In other words, the glare-limiting element can be used for the arrangement of the filtering element in those areas in which the filtering element overlaps the glare-limiting element. Moreover, such an overlap between the glare-limiting element and the filtering element renders a precise adaptation of the filtering element to areas of the protective trough spared by the glare-limiting element unnecessary.

Specifically for linear fluorescent luminaries it may prove to be advantageous if the glare-limiting element and/or the filtering element extend in the longitudinal direction of the luminaire over the entire length of the protective trough.

Depending on the geometry of the protective trough/protective cover and used protective bulb or the like, respectively, also annular or circular arrangements of the glare-limiting element and the filtering element are conceivable.

The protective trough substantially defines the range of a corresponding aperture angle for the light emerging from the illuminant. In linear fluorescent luminaries the aperture angle is substantially 180°, i.e. light is emitted to the entire lower half-space underneath the luminaire. However, the light distribution or light intensity in this half-space may vary, which may be predefined, for instance; by reflectors or the like inside the luminaire.

The corresponding aperture angle has a mean emission direction which is substantially determined by the bisectrix of the aperture angle. It may be favorable if the glare-limiting element is arranged symmetrically with respect to the mean emission direction of the luminaire.

Also asymmetrical arrangements are possible, however, for instance in order to configure the illumination by the luminaire in a predetermined way. This applies analogously also to the mounting of the filter.

It is possible to arrange the glare-limiting element and/or the filtering element when the luminaire is installed at the place of installation. To this end, luminaries of a common constructional design may be used, wherein the spectral and geometrical limitation of the emitted light is realized by correspondingly arranging or applying the filtering element and the glare-limiting element on/to the trough inner side.

Therefore, it is possible to retrofit the filtering element and/or the glare-limiting element in luminaries that are already installed, so that they may be designed as a retrofit kit.

Advantageous implementations will be explained in more detail below by means of the figures shown in the drawings. In the drawings:

DETAILED DESCRIPTION

Figure 1:
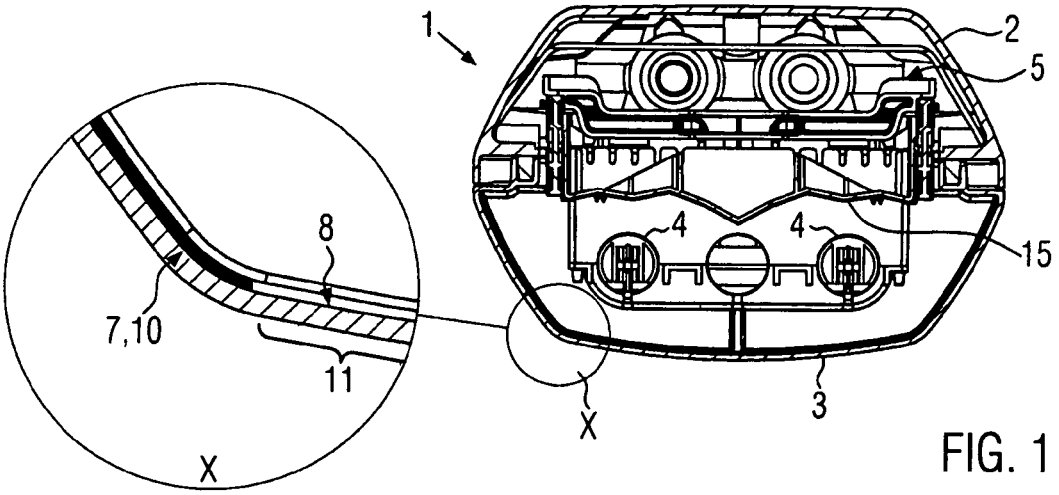
FIG. 1 shows a cross-section through a luminaire with an enlarged detail "X"
Figure 2:
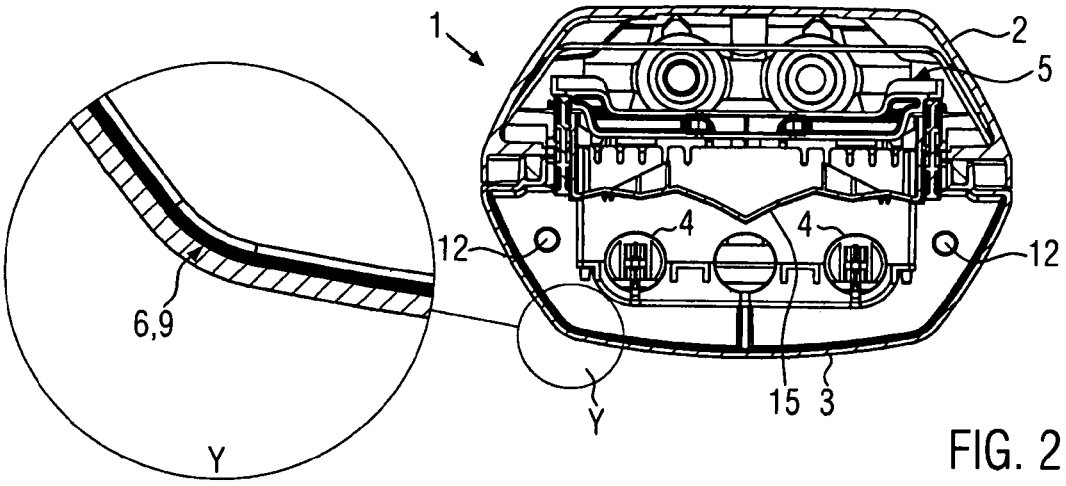
FIG. 2 shows a cross-section analogous to FIG. 1 in another embodiment with an enlarged detail "Y"
Figure 3:
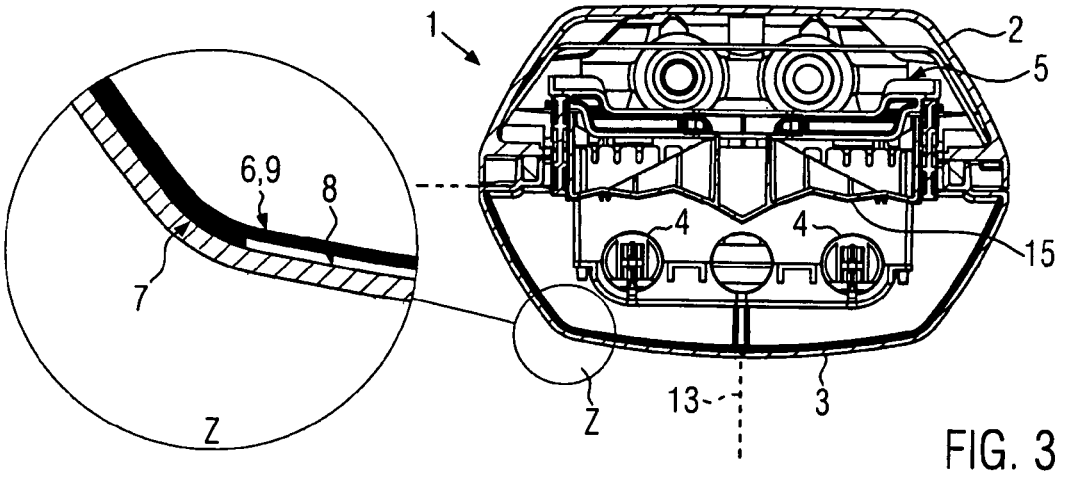
FIG. 3 shows a cross-section analogous to FIG. 1 in a third embodiment with an enlarged detail "Z".

FIGS. 1 to 3 each show cross-sections through a luminaire 1, which is designed as a linear fluorescent luminaire. Other luminaries are usable as well, however. The respective luminaries 1 substantially have the same constructional design, except for the filtering element 6 and the glare-limiting element 7, so that the luminaire is only described with respect to some details. Moreover, some implementations relate particularly to the specific filtering element and glare-limiting element, while the other components of the luminaire may correspond to known luminaries already in use.

A corresponding luminaire 1 includes at least one luminaire housing 2 and a protective trough 3. The luminaire housing 2 serves, for instance, to arrange the luminaire on a ceiling, a wall, a mast or the like. Corresponding luminaries may also be suspended lights or pendant lights as well as emergency lights or explosion-proof lights. Again, such emergency lights or explosion-proof lights may be ceiling lights, pendant lights, mast lights or other lights. In the embodiment shown the luminaire housing 2 and the protective trough 3 are substantially trough-shaped and are assigned to each other with their openings. Corresponding connections for the illuminants 4 as well as electric or electronic components 5 for operating the luminaire 1 can be mounted inside the luminaire housing 2. The protective trough 3 is light-transmitting, i.e. transparent or at least translucent.

Glass, quartz, polycarbonate or also other light-transparent or translucent plastics may be used as material for such a protective trough.

In the illustrated luminaries two illuminants 4 designed as fluorescent tubes are arranged parallel to each other. At least one reflector or also a group of reflectors 15 is arranged above the illuminants 4. On principle, these reflectors 15 determine the light distribution and at least the light intensity distribution.

A filtering element 6 and/or a glare-limiting element 7 is assigned to the protective trough 3. These are particularly applied to or arranged on a trough inner side 8 of the protective trough 3.

In FIG. 1 a corresponding glare-limiting element 7 is substantially applied to side walls of the protective trough 3 only, wherein a bottom of the protective trough forms an area 11 uncovered by the glare-limiting element 7. The glare-limiting element can be formed, for instance, as an opaque film 10, which can be arranged or applied directly on/to the trough inner side 8. The glare-limiting element 7 particularly extends in the longitudinal direction 12 of the luminaire 1 and the protective trough 3, respectively, i.e. substantially perpendicular relative to the cross-sections of the luminaire 1 illustrated in the figures.

It is possible that the glare-limiting element 7 extends over the entire length of the protective trough 3.

In the embodiment according to FIG. 2 a corresponding glare-limiting element 7 was omitted. Instead, a filtering element 6 is mounted on or applied to the trough inner side 8 of the protective trough 3 in a surface-covering fashion. The filtering element 6 is formed by a filtering film or filtering coating 9.

In the embodiment according to FIG. 2 it is also possible, however, that the filtering element is not applied to the complete trough inner side 8 to cover the entire surface, but only to certain areas.

In other respects, the constructional design of the luminaire 1 according to FIG. 2 is the same as that of luminaire 1 according to FIG. 1.

In the third embodiment according to FIG. 3 glare-limiting element 7 as well as filtering element 6 are assigned to the trough inner side 8 of the protective trough 3. The glare-limiting element 7 is arranged between the trough inner side 8 and the filtering element 6, with the filtering element 6 being arranged also in the uncovered area 11, see FIG. 1. At least partially an overlap of the filtering element 6 and the glare-limiting element 7 is accomplished, e.g. for holding the filtering element 6. By this overlap a precise adaptation of the filtering element 6 to the uncovered area 11 is not required.

In the embodiment according to FIG. 3 a clearance is formed in the enlarged detail "Z" between the trough inner side 8 and the filtering film 9 or filtering element 6, respectively. It is also possible, however, that the filtering film or filter, respectively, is arranged directly on the trough inner side 8 in this uncovered area.

Other combinations of filtering element and glare-limiting element are possible. For instance, the filtering element 6 may be provided only in specific longitudinal areas in the longitudinal direction 12 of the protective trough 3. Also, it is possible that the filtering element 6 does not cover the total area 11 of the trough inner side 8 that is not covered by the glare-limiting element. For instance, only a specific portion of this uncovered area may be covered by the filtering element 6 both in the cross-sectional direction and the longitudinal direction.

This applies analogously also to the embodiment example according to FIG. 2.

FIG. 3 further shows an aperture angle 14 for the light emergence of luminaire 1. This aperture angle is substantially 180°, so that light can be emitted by the luminaire 1 to the entire lower half-space.

A bisectrix of the corresponding aperture angle is defined as a mean emission direction 13. Specifically the glare-limiting element may be arranged symmetrically relative to this mean emission direction 13. This means, a corresponding glare-limiting element 7 is arranged on both sides of the mean emission direction, which are arranged axially symmetrically with respect to this mean emission direction 13. Also, it is possible that the glare-limiting element 7 is formed asymmetrically with respect to the mean emission direction 13 and also in a different fashion in the longitudinal direction 12 of the protective trough 3. This applies analogously also to the filtering element 6.

As the filtering element 6 permits a spectral selection with respect to the emitted light, however, it may be regarded as favorable if this filtering element 6 is arranged, as a rule in a surface-covering fashion, on the trough inner side of the protective trough or, in a surface-covering fashion, in the uncovered areas 11, respectively.

It follows from the embodiment examples according to FIGS. 1 to 3 that it is also possible to arrange the filtering element 6 and glare-limiting element 7 in the corresponding areas of the protective trough 3 only when the luminaire 1 is installed. Furthermore, it is also possible to provide the filtering element and/or the glare-limiting element in already installed luminaries subsequently in the form of a retrofit kit.

According to some implementations, the arrangement of a filtering element and/or a glare-limiting element inside a protective trough, and especially on the trough inner side thereof, is accomplished in an easy constructive and easy-to-mount and, hence, in a cost efficient manner. The filtering element effects a spectral filtering of the light emitted by the luminaire, so that the light emitted after the spectral filtering does not negatively affect, for instance, animals or the like. For instance, it has been found that certain animal species are influenced by certain spectral ranges. Such an influence may be an attraction of animals. In order to avoid this or make use of it certain spectral ranges of the emitted light, which cause this influencing of corresponding animals, can be blocked out. The remaining spectral ranges are sufficient for an illumination by the luminaire and, where applicable, are characterized only by a corresponding coloring of the light. As an alternative to such a spectral filtering, or also in combination with it, a geometrical limitation of the emitted light and particularly of the aperture angle 14 of the corresponding luminaire can be accomplished by the glare-limiting element 7. Thus, the luminaire is visible from certain areas to a smaller degree or not at all, while the areas spared or not covered by the glare-limiting element serve a sufficient illumination.

Both the filtering element and the glare-limiting element may be used in combination. Thus, a negative influence on the fauna is avoided or intensified, or a "light pollution" of the environment by an unlimited emission of light by a corresponding luminaire is avoided.

The invention claimed is:

1. A luminaire comprising:

a luminaire housing;

a transparent or translucent cover, wherein illuminants and associated electric or electronic components can be arranged in the luminaire housing and the cover is detachably connected to the luminaire housing;

a filter for spectrally filtering the light emitted by the illuminants, the filter assigned to the cover, wherein the filter is a filtering film or filtering coating arranged on or applied to an inner side of the cover; and a glare-limiter arranged on the inner side of the cover, wherein the glare-limiter is inserted into or glued to the cover, wherein the filter and the glare-limiter are formed to be complementary relative to the cover, and the filter is arranged at least in an area of the cover not covered by the glare-limiter.

2. The luminaire according to claim 1, wherein the filter is arranged or applied in a surface-covering fashion on/to transparent or translucent areas of the cover on the inner side thereof.

3. The luminaire according to claim 1, wherein the glare-limiter is an opaque film or a light-proof film.

4. The luminaire according to claim 1, wherein the filter is a coated plastic film.

5. The luminaire according to claim 1, wherein the glare-limiter is arranged between the inner side of the cover and the filter.

6. The luminaire according to claim 1, wherein at least one of the glare-limiter or the filter extends in the longitudinal direction of the luminaire over the entire length of the cover.

7. The luminaire according to claim 1, wherein the glare-limiter is arranged symmetrically with respect to a mean emission direction of the luminaire.

8. The luminaire according to claim 1, wherein the glare-limiter is arranged asymmetrically with respect to a mean emission direction of the luminaire.

9. The luminaire according to claim 1, wherein at least one of the glare-limiter or the filter can be arranged when the luminaire is installed at a place of installation.

10. The luminaire according to claim 1, wherein at least one of the glare-limiter or the filter is designed as a retrofit kit.

* * * * *